United States Patent [19]

Koyama et al.

[11] 4,387,889

[45] Jun. 14, 1983

[54] COPYING APPARATUS PROVIDED WITH A CASSETTE-TYPE PAPER FEEDING MECHANISM

[75] Inventors: Shigeo Koyama, Toyonaka; Ryutaro Yamagata, Nishinomiya; Nobuhiko Kozuka, Suita; Hiromi Sakata, Neyagawa, all of Japan

[73] Assignee: Mita Industrial Co., Ltd., Japan

[21] Appl. No.: 287,834

[22] Filed: Jul. 29, 1981

[30] Foreign Application Priority Data

Aug. 18, 1980 [JP] Japan ..... 55-116087[U]

[51] Int. Cl.[3] ..... B65H 5/06

[52] U.S. Cl. ..... 271/10; 271/22; 271/127; 271/162; 271/274

[58] Field of Search ..... 271/10, 22, 126, 127, 271/162, 164, 273, 274

[56] References Cited

U.S. PATENT DOCUMENTS 4,155,545 5/1979 Yanagawa ..... 271/274

4,254,202 3/1981 Matsumoto ..... 430/120

*Primary Examiner*—Richard A. Schacher

*Attorney, Agent, or Firm*—Beveridge, DeGrandi & Kline

[57] ABSTRACT

A copying apparatus provided with a cassette-type paper feeding mechanism. The paper feeding mechanism includes a cassette-receiving section disposed at an upstream end of a paper transfer passage defined within a housing and a copying paper cassette to be mounted to the cassette-receiving section through an opening formed in a side wall of the housing and is constructed such that when the paper cassette is inserted into the cassette-receiving section through the opening of the housing to set it at an inoperative position and further moved in a predetermined direction to set it at an operative position, a paper feeding member provided in the cassette-receiving section acts on a copying paper in the paper cassette to render it ready for feeding into the paper transfer passage. A pair of paper transfer rollers are provided at that position of the paper transfer passage which is in proximity to the cassette-receiving section, and at least one of these transfer rollers is mounted movably relative to the other. When the paper cassette is set at the operative position, said one transfer roller is in contact with said other transfer roller, but when the paper cassette is moved from the operative position to the inoperative position, the movement of the cassette is transmitted to said one transfer roller through a motion-transmitting member thereby to separate said one transfer roller from said other transfer roller.

5 Claims, 5 Drawing Figures

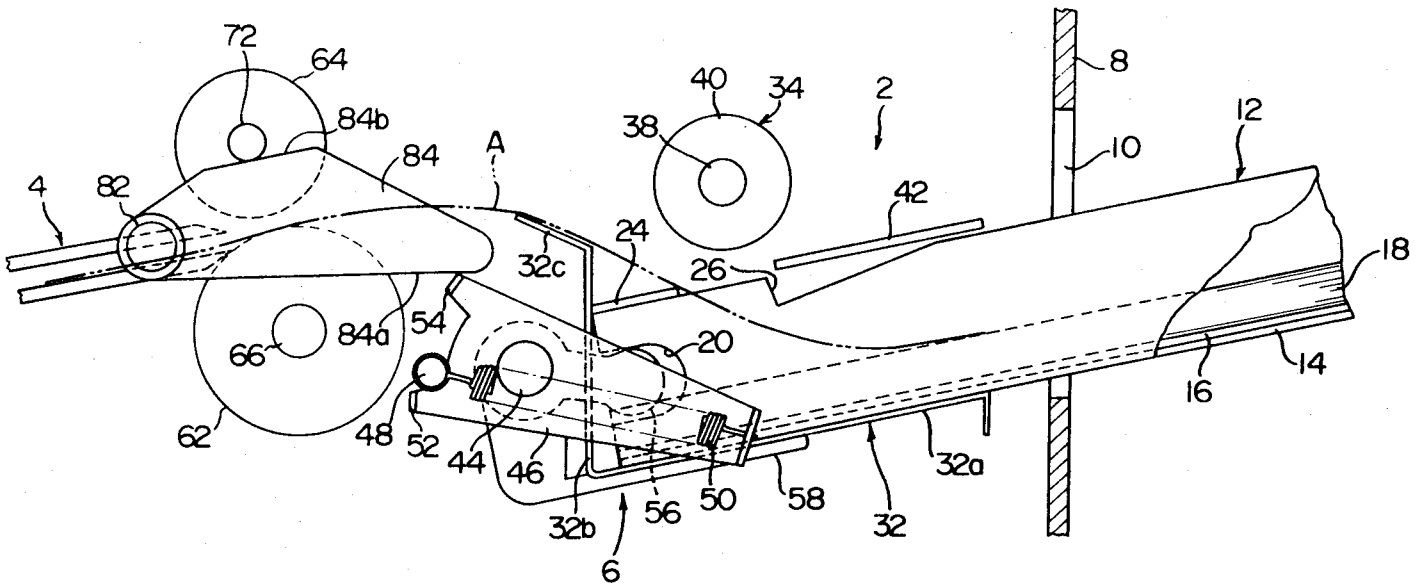
FIG. 2-A

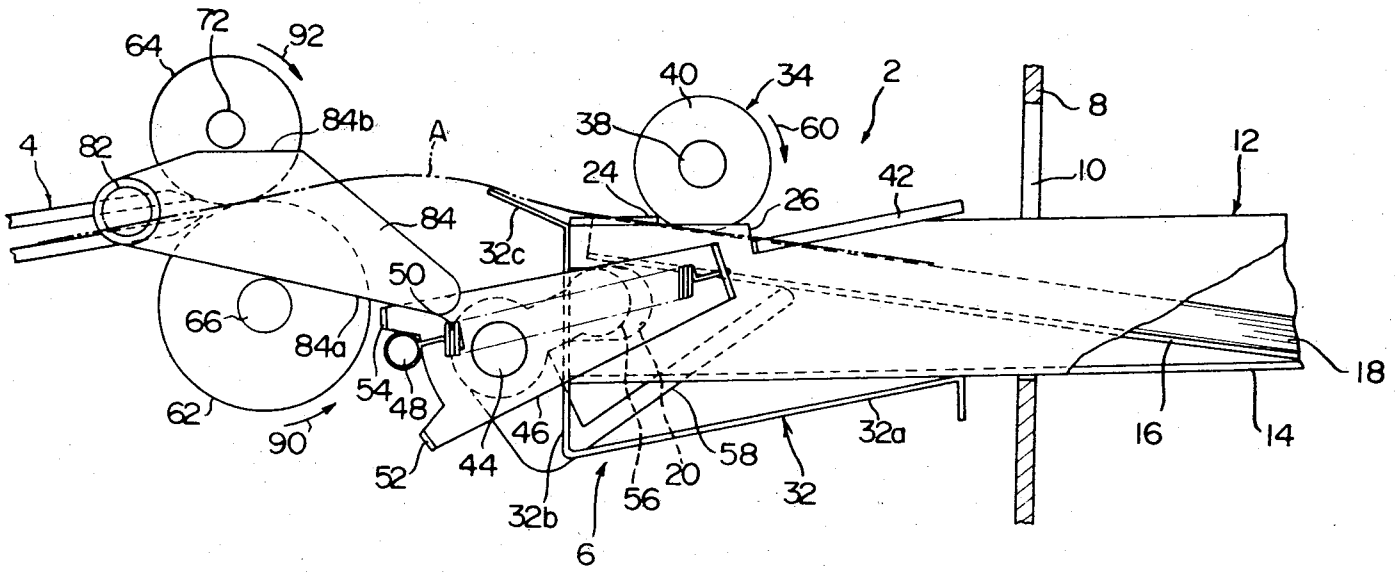
FIG. 2-B

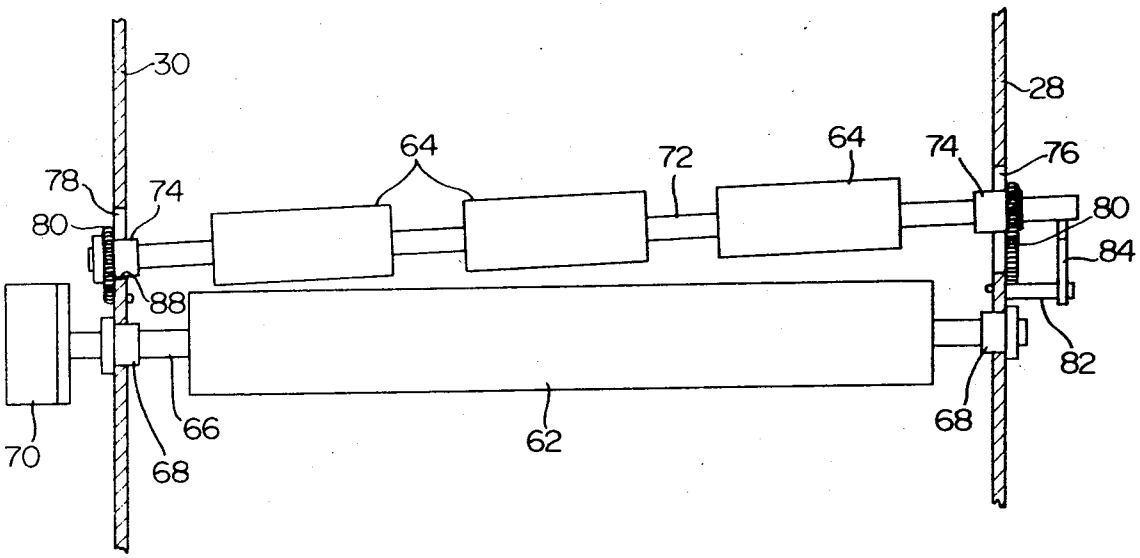
FIG. 3-A

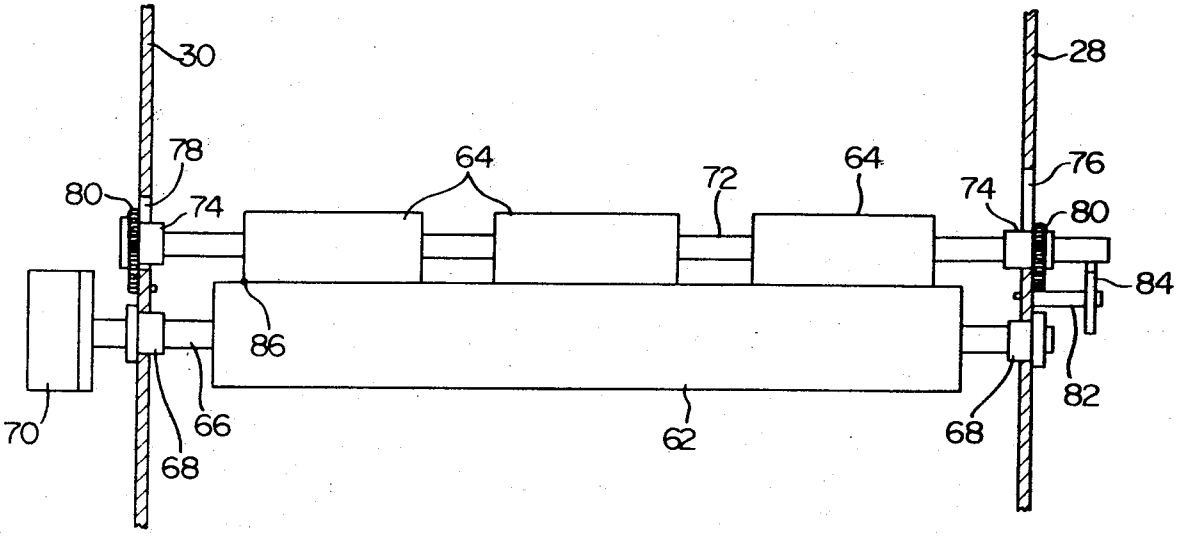
FIG. 3-B

COPYING APPARATUS PROVIDED WITH A CASSETTE-TYPE PAPER FEEDING MECHANISM

FIELD OF THE INVENTION

This invention relates to a copying apparatus provided with a cassette-type paper feeding mechanism.

DESCRIPTION OF THE PRIOR ART

In copying apparatuses such as direct-type (EF type) electrostatic copying apparatuses or transfer-type (PPCtype) electrostatic copying apparatuses, it is necessary to feed copying papers (photosensitive or receptor sheets) successively through a predetermined paper transfer passage defined within a housing. In recent years, a so-called cassette-type paper feeding mechanism has gained widespread acceptance. The cassette-type paper feeding mechanism, disclosed, for example, in Japanese Laid-Open Patent Publication No. 129639/1978, generally includes a cassette-receiving section disposed at an upstream end of a paper transfer passage defined within a housing and a copying paper cassette to be mounted to the cassette-receiving section through an opening formed in a side wall of the housing. This paper feed mechanism is constructed such that when the paper cassette is inserted into the cassette-receiving section through the opening of the housing to set it at its inoperative position and is then moved further in a predetermined direction to set it at its operative position, a paper feeding member such as a paper feed roller provided in the cassette-receiving section acts on a copying paper in the cassette to render it ready for feeding into the paper feeding passage. On the other hand, a pair of paper transfer rollers are disposed at that position of the paper transfer passage which is in proximity to the cassette-receiving section, and a copying paper fed into the paper transfer passage from the cassette by the action of the paper feeding member is transferred while being nipped by the transfer rollers. Transfer of the copying paper is continued by the cooperative action of multiple pairs of other paper transfer rollers disposed in the paper transfer passage at suitable intervals.

It is well known to those skilled in the art that in copying apparatuses provided with the cassette-type paper feeding mechanism described above, a copying paper fed into the transfer passage from the cassette may be jammed while its trailing end portion is located still in the cassette but its leading end portion is nipped by the pair of paper transfer rollers provided near the cassette-receiving section. Thus, the conventional copying apparatuses are also constructed such that one of the paper transfer rollers is mounted movably relative to the other, and in the event of paper jamming in the aforesaid state, one of the rollers is manually moved to stop the nipping of the copying paper by the transfer rollers, thus enabling the jammed paper to be released.

With the conventional copying apparatuses, however, removing of the jammed paper in the above state must be effected by a troublesome operation which comprises first moving the paper cassette held at the operative position to its inoperative position, then opening the front wall of the housing, moving one of the paper transfer rollers by one hand to stop the nipping of the papers by the paper transfer rollers, and while maintaining this condition, inserting the other hand into the housing through the opeing formed in its side wall and pulling out the jammed paper therefrom.

SUMMARY OF THE INVENTION

The primary object of this invention is to provide a novel and excellent copying apparatus which is improved such that in the event of paper jamming in the aforesaid state, the jammed paper can be removed rapidly and easily by a very simple operation.

According to this invention, there is provided a copying apparatus including (1) a cassette-type paper feeding mechanism having a cassette-receiving section disposed at an upstream end of a copying paper transfer passage defined within a housing and a copying paper cassette to be mounted to the cassette-receiving section through an opening formed in a side wall of the housing, said paper feeding mechanism being constructed such that when the paper cassette is inserted into the cassette-receiving section through the opening of the housing to set it at an inoperative position and further moved in a predetermined direction to set it at an operative position, a paper feeding member provided in the cassette-receiving section acts on a copying paper in the paper cassette to render it ready for feeding into the paper transfer passage, and (2) a pair of paper transfer rollers provided at that position of the paper transfer passage which is inproximity to the cassette-receiving section, at least one of said paper transfer rollers being mounted movably relative to the other; characterized in that when the paper cassette is set at the operative position, said one transfer roller is in contact with said other transfer roller, but when the paper cassette is moved from the operative position to the inoperative position, the movement of the cassette is transmitted to said one transfer roller through a motion-transmitting member thereby to separate said one transfer roller from said other transfer roller.

In the event that a copying paper fed into the paper transfer passage from the paper cassette should be jammed in the copying apparatus of this invention while its trailing end portion is still located in the paper cassette but its leading end portion is nipped by the pair of paper transfer rollers provided in proximity to the cassette-receiving section, one has only to move the cassette located at its operative position to its inoperative position in order to get it right. As a result of this simple manipulation, the copying paper in the cassette is separated from the paper feeding member provided in the cassette-receiving section, and the movement of the cassette is transmitted to one of the paper transfer rollers through the motion-transmitting member to release the paper from nipping between the transfer rollers. Accordingly, by simply inserting a hand into the housing through the opening formed in its side wall and pulling the jammed paper subsequent to the aforesaid movement of the paper cassette, the jammed paper can be withdrawn. In this manner, the jammed paper can be rapidly and easily removed by a simple operation in accordance with this invention.

BRIEF DESCRIPTION OF THE ACCOMPANYING DRAWINGS

FIG. 1 is a partial perspective view showing a part of one embodiment of the copying apparatus constructed in accordance with this invention;

FIGS. 2-A and 2-B are partial sectional views showing the copying apparatus in FIG. 1 when a copying paper cassette is at an inoperative position and at an operative position, respectively; and FIGS. 3-A and 3-B are partial sectional views showing a pair of paper transfer rollers of the copying apparatus in FIG. 1 when a copying paper cassette is at an inoperative position and at an operative position, respectively.

DETAILED DESCRIPTION OF THE PREFERRED EMBODIMENTS

Figure 1:
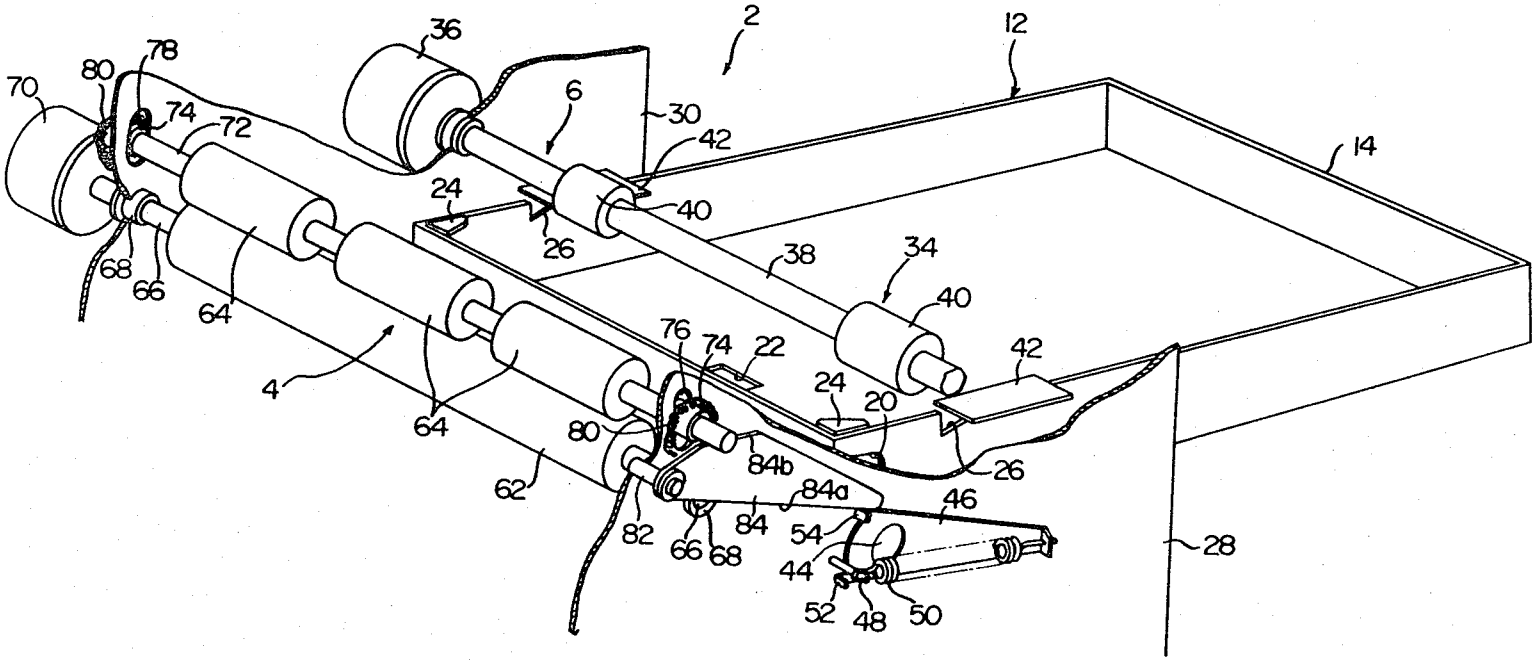

The invention is described in detail with reference to the accompanying drawings which show a cassette-type paper feeding mechanism and an upstream end section of a copying paper transfer passage provided adjacent thereto in one embodiment of the copying apparatus constructed in accordance with this invention.

Referring to FIGS. 1, 2-A and 2-B, the cassette-type paper feeding mechanism generally shown at 2 includes a cassette-receiving section 6 located at the upstream end of a copying paper transfer passage 4 (only its upstream end section is shown in the drawings) defined within the housing of the copying apparatus and a copying paper cassette 12 to be mounted to the cassette-receiving section 6 through an opening 10 formed on a side wall 8 (FIGS. 2-A and 2-B) of the housing.

The paper cassette 12 in the illustrated embodiment has a substantially rectangular casing 14 having an open top. The casing 14 contains an auxiliary bottom plate 16 made of a relatively rigid material such as a paperboard, metallic plate or plastic plate and a layer 18 of copying paper sheets of a predetermined size placed on the auxiliary bottom plate 16 (in FIG. 1, the auxiliary bottom plate 6 and the copying paper layer 18 are omitted). Recesses 20 for receiving fitting levers are formed on opposite sides of the casing 14 at its forward end portion, and an opening 22 (FIG. 1) for receiving a lifting lever is formed centrally at the forward end of the bottom plate of the casing 14. Paper end-restraining members 24 are fixed to the upper ends of both corners of the forward end of the casing 14. Furthermore, wedge-like cuts 26 are formed on the upper edges of both side plates of the casing 14 in the forward end section of the casing 14.

The cassette receiving section 6 in the illustrated embodiment is defined between a front vertical base plate 28 and a rear vertical base plate 30 (FIG. 1) spaced from each other within the housing, and includes a receiving member 32 (see FIGS. 2-A and 2-B because it is omitted in FIG. 1 for clarity of the drawing) adapted for action on the forward end portion of the copying paper cassette 12 to be inserted through the opening 10 formed on the side wall 8 of the housing. The receiving member 32 fixed between the front vertical base plate 28 and the rear vertical base plate 30 has a cassette bottom guiding portion 32*a* extending inwardly from near the opening 10 such that it inclines downwardly at a predetermined angle, a cassette end abutting portion 32*b* extending upwardly in a substantially perpendicular direction from the inside end of the cassette bottom guiding portion 32*a*, and a copying paper guiding portion 32*c* extending inwardly further from the upper end of the abutting portion 32*b*. A copying paper feeding member 34 is disposed above the receiving member 32 at a predetermined distance from the cassette bottom guiding portion 32*a*. The paper feeding member 34 in the illustrated embodiment is composed of a shaft 38 mounted rotatably between the front vertical base plate 28 and the rear vertical base plate 30 and connected to a drive power source through a suitable clutch mechanism 36 (FIG. 1) for selective rotation, and a roller 40 fixed to the shaft 38. Above the cassette bottom guiding portion 32*a* of the receiving member 32, a pair of stop plates 42 acting on the cuts 26 formed in the cassette casing 14 are fixed respectively to the front vertical base plate 28 and the rear vertical base plate 30. Inwardly of the abutting portion 32*b* of the receiving member 32, a rotating shaft 44 extending along the abutting portion 32*b* is mounted rotatably on the front vertical base plate 28 and the rear vertical base plate 30. To one end (the front end in the illustrated embodiment) of the rotating shaft 44 is fixed in fan-shaped position-setting member 46. A stop pin 48 implanted in the front vertical base plate 28 and a tension spring 50 is stretched between the stop pin 48 and one end (the right end in FIGS. 1, 2-A and 2-B) of the position-setting member 46. A pair of protruding portions 52 and 54 for engagement with the stop pin 48 are formed at the other end (the left end in FIGS. 1, 2-A and 2-B) of the position-setting member 46. That part of the end portion of the position-setting member 46 which is between the protruding portions 52 and 54 is formed in an arcuate edge having a predetermined curvature. The position-setting member 46, the stop pin 48 and the tension spring 50 are constructed such that the tension spring 50 is most stretched in a state intermediate between the state shown in FIG. 2-A and the state shown in FIG. 2-B, and therefore the tension spring 50 elastically biases the position-setting member 46 in the state illustrated in FIG. 2-A (i.e., the state in which the protruding portion 52 comes into engagement with the stop pin 48) or in the state shown in FIG. 2-B (i.e., the state in which the protruding portion 54 comes into engagement with the stop pin 48). A pair of fitting levers 56 (FIGS. 2-A and 2-B) are fixed to the rotating shaft 44 in a spaced-apart relation by a distance corresponding to the width of the paper cassette 12. In addition, at a position intermediate between the fitting levers 56, a lifting lever 58 (FIGS. 2-A and 2-B) is mounted to the rotating shaft 44. When the rotating shaft 44 is at the angular position shown in FIG. 2-A, the lifting lever 58 is maintained in the state shown in FIG. 2-A (i.e., the state in which it adjoins the undersurface of the cassette bottom guiding portion 32*a* of the receiving member 32. When the rotating shaft 44 is brought to the angular position shown in FIG. 2-B, the lifting lever 58 is biased counterclockwise in FIGS. 2-A and 2-B by the elastic biasing action of a spring (not shown) disposed between the rotating shaft 44 and the lifting lever 58 and abuts against the auxiliary bottom plate 16 in the cassette 12 through an opening (not shown) formed in the receiving member 32 and the opening 22 (FIG. 1) formed centrally in the forward end of the bottom plate of the cassette 12, thereby forcing the auxiliary bottom plate 16 and the copying paper layer 18 on it upwardly and bringing both front end corners of the topmost copying paper of the layer 18 into abutment with the paper end restraining members 24.

The construction of the cassette 12 and the cassette-receiving section 6 of the cassette-type paper feeding mechanism 2, which have been described hereinabove, does not form a novel feature of the copying apparatus of the invention, and may be substantially the same as that disclosed in Japanese Laid-Open Patent Publication No. 129639/1978. Accordingly, for details of the construction of the copying paper cassette 12 and the cassette-receiving section 6 themselves, reference may be made to the disclosure of the above-cited Japanese Laid-Open Patent Publication No. 129639/1978. In the present specification, the operation of these members of the paper feeding mechanism 2 is briefly described below.

To mount the cassette 12 to the cassette-receiving section 6, the front portion of the cassette 12 is inserted into the housing through the opening 10 formed in the side wall 8. Then, while contacting the bottom surface of the cassette 12 with the bottom guiding portion 32*a* of the receiving member 32, the cassette 12 is advanced until its front end abuts against the cassette end abutting portion 32*b* of the receiving member 32. Thus, the cassette 12 is set at the inoperative position shown in FIG. 2-A. This results in the fitting of the fitting levers 56 fixed to the rotating shaft 44 into the recesses 20 formed on both sides of the front end portion of the cassette 12. Then, the cassette 12 is turned in a direction in which its front end moves upwardly. As a result, as shown in FIG. 2-B, the cuts 26 of the cassette 12 are engaged with the stop plates 42 to stop the turning of the cassette 12 and exactly hamper the rearward movement of the cassette 12. Thus, the cassette 12 is set at the operative position shown in FIG. 2-B. At this time, the fitting levers 56 and the rotating shaft 44 are turned counterclockwise in FIGS. 2-A and 2-B following the turning of the cassette 12, and the rotating shaft 44 is brought to an angular position at which the protruding portion 54 of the position-setting member 46 comes into engagement with the stop pin 48. Consequently, the lifting lever 58 is elastically biased counterclockwise in FIGS. 2-A and 2-B by the elastic biasing action of a spring (not shown), and the forward end portion of the lifting lever 58 passes through an opening (not shown) formed in the receiving member 32 and the opening 22 (FIG. 1) formed in the bottom plate of the cassette 12 and forces the auxiliary bottom plate 16 in the cassette 12 and the copying paper layer 18 on it upwardly, whereby both front end corners of the topmost copying paper are caused to abut against the paper end-restraining members 24. At the same time, the topmost copying paper is contacted with the roller 40 constituting the paper feeding member 34 to achieve a state in which the copying paper is ready for feeding to the paper transfer passage 4 by the action of the paper feeding member 34, more specifically a state in which the copying paper is ready for feeding to the paper transfer passage 4 by the rotation of the roller 40 in the direction of an arrow 60.

When it is desired to remove the paper cassette 12 from the cassette-receiving section 6, the above mounting operation is performed in the reverse order. Specifically, the paper cassette 12 at the operative position shown in FIG. 2-B is turned in a direction in which its forward end moves downwardly, thereby to set it at the inoperative position shown in FIG. 2-A. Then, the cassette 12 is pulled rearwardly.

Now, with reference to FIGS. 3-A and 3-B in conjunction with FIGS. 1, 2-A and 2-B, the upstream end section of the paper transfer passage 4 is described. A pair of paper transfer rollers 62 and 64 are provided at the upstream end section of the paper transfer passage 4 in the vicinity of which the aforesaid cassette-receiving section 6 is disposed. It is important that at least one of the rollers 62 and 64 should be mounted movably relative to the other. In the illustrated embodiment, the lower roller 62 is mounted rotatably by fixing bearing members 68 secured to the opposite ends of a supporting shaft 66 for the roller 62 to predetermined positions of the front vertical base plate 28 and the rear vertical base plate 30 respectively. The supporting shaft 66 for the lower roller 62 is connected for selective rotation to a drive power source (not shown) through a suitable clutch mechanism 70. The upper roller 64, on the other hand, is mounted by inserting bearing members 74 secured to the opposite end portions of a supporting shaft 72 for the roller 64 into a long hole 76 formed in the front vertical base plate 28 and a long hole 78 formed in the rear vertical base plate 30, respectively. The long holes 76 and 78 extend perpendicularly (substantially perpendicularly in the illustrated embodiment) with respect to the support shaft 72 for the upper roller 64. Hence, the upper roller 64 is not only rotatable, but also movable along the long holes 76 and 78 over a predetermined range defined by the long holes 76 and 78, and therefore movable relative to the lower roller 62. Springs 80 provided in the front vertical base plate 28 and the rear vertical base plate 30 respectively are wound around the two opposite end portions of the supporting shaft 72. The springs 80 elastically bias the upper roller 64 downwardly, and as will be described in detail hereinbelow, cause the upper roller 64 to abut against the lower roller 62 when the paper cassette 12 is at the aforesaid operative position (the position shown in FIG. 2-B).

The novel feature of the copying apparatus of the invention is that at least one of the paper transfer rollers 62 and 64 (the upper roller 64 in the illustrated embodiment) is moved according to the position of the paper cassette 12. That structure of the copying apparatus of the invention which is conducive to this novel feature is described below in detail.

In the illustrated embodiment, a motion-transmitting member 84 is mounted pivotably to the front vertical base plate 28 by means of a pin 82 at a position adjacent one end portion of the supporting shaft 72 for the upper roller 64. The transmitting member 84 is biased clockwise in FIGS. 2-A and 2-B by its own weight or by the elastic biasing action of a spring (not shown), and its lower edge 84*a* is kept in contact with the protruding portion 54 of the position-setting member 46 described hereinabove.

When the cassette 12 is at the operative position shown in FIG. 2-B and the rotating shaft 44 disposed in the cassette-receiving section 6 and the position-setting member 46 fixed to one end of the shaft 44 are at the angular position shown in FIG. 2-B (the angular position at which the protruding portion 54 of the position-setting member 46 comes into engagement with the stop pin 48), the transmitting member 84 is maintained at the angular position shown in FIG. 2-B, and is apart from one end portion of the supporting shaft 72 for the upper roller 64. In this state, as shown in FIGS. 2-B and 3-B, the upper roller 64 is caused to abut elastically against the lower roller 62 by the elastic biasing action of the springs 80 wound about the end portions of the supporting shaft 72. On the other hand, when the paper cassette 12 is held at the inoperative position shown in FIG. 2-A, or when it is out of the cassette-receiving section 6, the rotating shaft 44 disposed in the cassette-receiving section 6 and the position-setting member 46 fixed to one end thereof are located at the angular position shown in FIG. 2-A (i.e., at the angular position at which the protruding portion 52 of the position-setting member 46 is in engagement with the stop pin 48). When the position-setting member 46 is at the angular position shown in FIG. 2-A, its protruding portion 54 abuts against the lower edge 84*a* of the transmitting member 84 to determine the angular position of the transmitting member 84. Consequently, the transmitting member 84 is brought to the angular position shown in FIG. 2-A by being turned counterclockwise in FIG. 2-B (and FIG. 2-A) from the angular position shown in FIG. 2-B. When the cassette 12 is moved from the operative position shown in FIG. 2-B to the inoperative position shown in FIG. 2-A and thereby the transmitting member 84 is turned counterclockwise in FIG. 2-B (and FIG. 2-A) from the angular position shown in FIG. 2-B, the upper edge 84*b* of the transmitting member 84 abuts against one end portion of the supporting shaft 72 for the upper roller 64 to move the one end portion of the supporting shaft 72 upwardly against the elastic biasing action of the spring 80. As a result, as will be readily appreciated from FIGS. 3-B and 3-A, the upper rolle- 64 is first turned counterclockwise in FIGS. 3-B (and 3-A) about a site shown at 86 in FIG. 3-B, i.e., a site farthest from the aforesaid one end of the supporting shaft 72 among those sites of contact which are between the upper roller 64 and the lower roller 62, as a fulcrum. When the upper roller 64 has been turned through some angle, the other end portion of the supporting shaft 72 for the upper roller 64 (more specifically, the bearing member 74 mounted there) abuts against the lower end of the long hole 78 formed in the rear vertical base plate 30, and thereafter, the upper roller 64 is turned counterclockwise in FIG. 3-A (and FIG. 3-B) about the other end portion of the supporting shaft 72, i.e., the site shown at 88 in FIG. 3-A, as a fulcrum, whereupon the entire roller 64 is separated from the lower roller 62 as clearly shown in FIG. 3-A.

The advantages brought about by the provision of the motion-transmitting member 84 are described below.

When a copying operation is carried out by the copying apparatus, the paper cassette 12 is, of course, set at the operative position shown in FIG. 2-B. If, in this consition, the roller 40 of the paper feeding member 34 is rotated in the direction shown by arrow 60, the topmost sheet of the copying paper layer 18 within the cassette 12 is delivered from the cassette 12 by the action of the roller 40 and fed between the pair of paper transfer rollers 62 and 64 while being guided by the paper guiding portion 32*c* of the receiving member 32. In the meantime, the paper transfer rollers 62 and 64 are in such a state that as shown in FIG. 2-B, the upper roller 64 is elastically urged against the lower roller 62 by the elastic biasing action of the springs 80, and the lower roller 62 is rotated in the direction of an arrow 90 whereas the upper roller 64 is rotated in the direction of an arrow 92 following the rotation of the lower roller 62. Accordingly, the copying paper transfer rollers 62 and 64 nip therebetween the copying paper sheet fed by the action of the roller 40 of the paper feeding member 34, and transfer it further along the paper transfer passage 4.

As is well known to those skilled in the art, a copying paper may be jammed in the state shown by a two-dot chain line A in FIG. 2-B, i.e., in the state in which the leading end portion of the paper fed into the transfer passage 4 from the cassette 12 is nipped by the transfer rollers 62 and 64 whereas its trailing end portion is located still in the cassette and is in contact with the roller 40 of the paper feeding member 34. In the event that paper jamming should occur, the operation of the copying machine and the rotation of the copying paper feed member 34 and the paper transfer rollers 62 and 64 are stopped by a suitable control means known per se (not shown) in order to prevent further paper jamming. To resume the copying operation, the jammed paper must be removed.

In the copying apparatus constructed in accordance with this invention, a jammed paper sheet can be rapidly and easily removed by performing a simple operation to be described below. When a paper sheet is jammed in the state shown by the two-dot chain line A in FIG. 2-B, the paper cassette 12 at the operative position shown in FIG. 2-B is moved to the inoperative position shown in FIG. 2-A. As a result, the paper is moved away from the roller 40 of the paper feeding member 34, and the aforesaid movement of the cassette 12 causes the motion-transmitting member 84 to be turned to the angular position shown in FIG. 2-A from the angular position shown in FIG. 2-B. By this turning movement of the transmitting member 84, the upper roller 64 is separated from the lower roller 62 and nipping of the jammed paper by the pair of the upper and lower rollers 64 and 62 is nullified. Accordingly, subsequent to the aforesaid movement of the cassette 12, the jammed paper can be drawn and removed by simply pulling it with a hand through the opening 10 formed in the side wall 8 of the housing. This procedure does not require additional operations essential in conventional copying apparatuses, for example an operation of releasing the jammed copying paper from nipping between a pair of paper transfer rollers by independently manipulating the transfer rollers after the paper cassette has been moved.

While one embodiment of the copying apparatus constructed in accordance with this invention has been described in detail hereinabove with reference to the accompanying drawings, it is to be understood that various changes and modifications are possible without departing from the scope of the invention.

For example, although the present invention has been described hereinabove with regard to a copying apparatus provided with a cassette-type paper feeding mechanism 2 including the paper cassette 12 of a specified form and the cassette-receiving section 6, the present invention can be equally applied to copying apparatuses provided with any form of cassette-type paper feeding mechanism which allows a cassette mounted to the cassette-receiving section to be suitably moved between its operative position and inoperative position.

Furthermore, in the illustrated embodiment, the movement of the paper cassette 12 from its operative position to its inoperative position is transmitted only to one end portion of one (i.e., the upper roller 64) of the pair of paper transfer rollers 62 and 64 through the transmitting member 84, and nipping of the copying paper by the rollers 62 and 64 is stopped by moving one end portion of one of the transfer rollers 62 and 64. If desired, nipping by the transfer rollers may also be stopped by transmitting the movement of the paper cassette from its operative position to its inoperative position to both end portions of one of the transfer rollers and moving both end portions of the one roller. In still another embodiment, nipping by the transfer rollers may be nullified by mounting both of the transfer rollers movably, transmitting the movement of the paper cassette from its operative position to its inoperative position to both of the transfer rollers, and moving both of the transfer rollers.

Furthermore, although in the illustrated embodiment, the movement of the paper cassette 12 is transmitted to the transmitting member 84 through the position-setting member 46 and thence to one of the transfer rollers 62 and 64, it is possible, if desired, to transmit the movement of the paper cassette to one or both of the paper transfer rollers only through a motion-transmitting member of a suitable form.

What we claim is:

1. A copying apparatus including a cassette-type paper feeding mechanism having a cassette-receiving section disposed at an upstream end of a copying paper transfer passage defined within a housing and a copying paper cassette to be mounted to the cassette-receiving section through an opening formed in a side wall of the housing, said paper feeding mechanism being constructed such that when the paper cassette is inserted into the cassette-receiving section through the opening of the housing to set it at an inoperative position and further moved in a predetermined direction to set it at an operative position, a paper feeding member provided in the cassette-receiving section acts on a copying paper in the paper cassette to render it ready for feeding into the paper transfer passage, and a pair of paper transfer rollers provided at that position of the paper transfer passage which is in proximity to the cassette-receiving section, at least one of said paper transfer rollers being mounted movably relative to the other;

said apparatus being characterized in that when the paper cassette is set at the operative position, said one transfer roller is in contact with said other transfer roller, but when the paper cassette is moved from the operative position to the inoperative position, the movement of the cassette is transmitted to said one transfer roller through a motion-transmitting member thereby to separate said one transfer roller from said other transfer roller.

2. The copying apparatus of claim 1 wherein said one paper transfer roller is movable relative to said other transfer roller by mounting both end portions of a supporting shaft for said one roller to long holes extending perpendicularly to said supporting shaft, and wherein elastic members are attached to the opposite end portions of the supporting shaft, and when the paper cassette is set at the operative position, said one transfer roller is caused to abut against said other transfer roller by the elastic biasing action of the elastic members.

3. The copying apparatus of claim 2 wherein said motion-transmitting member is pivotably disposed adjacent one end portion of the supporting shaft for said one transfer roller and is adapted to be turned incident to the movement of the paper cassette from the operative position to the inoperative position, and during this pivotal movement, the motion-transmitting member abuts against said one end portion of said supporting shaft to move said one end portion against the elastic biasing action of the elastic members thereby to separate said one transfer roller from said other transfer roller.

4. The copying apparatus of claim 3 wherein when the motion-transmitting member begins to move said one end portion of said supporting shaft, the other end portion of said supporting shaft abuts against one end of said long hole, and thereafter, said supporting shaft is caused to pivot about the other end portion of said supporting shaft as a fulcrum.

5. The copying apparatus of claim 3 or 4 wherein the paper cassette is constructed so as to be movable from the inoperative position to the operative position by the upward movement of its front end, and the cassette-receiving section has disposed therein a rotating shaft which comes into engagement with the paper cassette when the cassette is set at the inoperative position through the opening of the housing and is rotated incident to the movement of the cassette when the cassette is moved from the inoperative position to the operative position, and wherein when the paper cassette is moved from the inoperative position to the operative position, a member fixed to one end portion of said rotating shaft acts on the motion-transmitting member to turn it pivotally, whereby the movement of the paper cassette is transmitted to said one transfer roller through the rotating shaft, the member fixed to one end of the rotating shaft and the motion-transmitting member.

* * * * *